US006873120B2

(12) United States Patent
El Bitar

(10) Patent No.: US 6,873,120 B2
(45) Date of Patent: Mar. 29, 2005

(54) POWER CONSUMPTION CONTROLLER FOR PRESSURIZED GAS LIGHTS

(75) Inventor: Salim J. El Bitar, Tripoli (LB)

(73) Assignee: Bitar Innovations, Inc., Irvine, CA (US)

( * ) Notice: Subject to any disclaimer, the term of this patent is extended or adjusted under 35 U.S.C. 154(b) by 192 days.

(21) Appl. No.: 10/286,101

(22) Filed: Nov. 1, 2002

(65) Prior Publication Data

US 2003/0132720 A1 Jul. 17, 2003

Related U.S. Application Data

(60) Provisional application No. 60/350,137, filed on Nov. 2, 2001.

(51) Int. Cl.[7] ..... G05F 1/00

(52) U.S. Cl. ..... 315/299; 315/276; 315/149; 315/308; 315/309; 307/141

(58) Field of Search ..... 315/291, 299, 315/136, 276, 283, 362, DIG. 5, DIG. 7, 149, 307–309; 307/141, 141.4

(56) References Cited

U.S. PATENT DOCUMENTS 3,636,404 A * 1/1972 Appleton ..... 428/578
4,134,043 A * 1/1979 Nuver ..... 315/92
4,135,115 A * 1/1979 Abernethy et al. ..... 315/97
4,206,385 A * 6/1980 Wisbey ..... 315/119
4,236,100 A * 11/1980 Nuver ..... 315/92
4,417,181 A * 11/1983 Leale ..... 315/209 R
4,434,388 A * 2/1984 Carver et al. ..... 315/307
4,513,224 A * 4/1985 Thomas ..... 315/141
4,766,352 A * 8/1988 Widmayer ..... 315/244
4,777,379 A * 10/1988 Young ..... 307/41
4,859,914 A * 8/1989 Summa ..... 315/354
4,931,701 A * 6/1990 Carl ..... 315/240
5,442,261 A * 8/1995 Bank et al. ..... 315/307
6,011,329 A * 1/2000 McGovern ..... 307/141.4

* cited by examiner

*Primary Examiner*—Thuy Vinh Tran
(74) *Attorney, Agent, or Firm*—Perkins Coie LLP

(57) ABSTRACT

A power controller for the regulation of power consumption by gas pressurized vapor lamps includes a series of stages that steps down power being applied to the lamp without a significant loss of luminescence. Once the gas vapor has been heated to achieve luminescence, the power can be decreased based on several criteria including time, luminescence, and gas temperature. By removing the excess power being applied to the lamp, the same luminescence can be maintained using significantly less energy.

22 Claims, 11 Drawing Sheets

POWER CONSUMPTION CONTROLLER FOR PRESSURIZED GAS LIGHTS

CROSS-REFERENCE TO RELATED APPLICATION

This application claims the benefit of U.S. Provisional Patent Application No. 60/350,137 filed 2 Nov. 2001, which is incorporated by reference in its entirety.

FILED OF THE INVENTION

The following disclosure relates generally to gas pressurized lights and more particularly to power consumption regulators for gas pressured lights.

BACKGROUND OF THE INVENTION

The gas pressurized street light is a product of many years of organized research for a utilitarian light source that is more efficient than the incandescent lamp. Its success is demonstrated by its almost universal application throughout our society. Few if any municipalities or corporate environments lack any such lights. While more efficient than the incandescent light, the total amount of energy needed to light an average sized city can be staggering. As cities expand and industry grows, more and more lights are employed for both safety and operation purposes. Until recently, the primary focus of advancement and research regarding such lights has been to increase their luminescence and applicability. The amount of energy these lights consume is now, however, becoming more and more of an interest. As the numbers of such lamps grow so does the total energy consumption and so does the need for a more economical and efficient way to operate them.

To help conserve energy many lamps now in use incorporate a dual design. FIG. 1 shows a typical gas pressurized light configuration 100. The light contains a high luminescence lamp 110 and a low luminescence lamp 120. The controller 130 couples the lamps to a transformer 140, which has two power steps 150, one associated with each lamp. A high power setting is coupled with one lamp 110 that produced a high luminescence in order to maximize illumination of an area during periods when more light is needed such as before midnight when the streets may be more crowded. Another combination uses a lower power setting and lamp 120 that produces less luminescence yet requires less energy. Each lamp however is an independent lighting source within the one light.

Street lamps are typically an evacuated bulb of glass enclosing an anode and a cathode. Contained within the glass bulb is also a small amount of a metallic vapor. A voltage applied to the cathode and anode creates an arc potential causing the temperature of the gas to increase. Alternatively, a filament within the glass bulb is heated to raise the gas temperature. Once the gas reaches a threshold temperature, light is emitted. As the temperature of the gas grows and heat is accumulated the color of the light transitions from a dull red or amber to a brilliant orange-yellow or blue depending on the type of metallic vapor within the lamp. The power necessary to initiate the light emitting characteristic of a gas pressurized lamp is not equal to the power necessary to maintain luminescence. A significant amount of power is required to heat the gas to a threshold that will cause the lamp to emit light. However, once the heat has been accumulated and the gas vapor is emitting light, the power necessary to maintain the luminescence is significantly less than that needed to initiate the illumination.

Unfortunately, should the temperature of the gas drop below the level required for illumination, luminescence must be reinitiated using a higher than maintenance power levels. Current designs do not address the differences in the power required to initiate luminescence and the power required to maintain luminescence. Accordingly, a significant amount of power is needlessly applied to the lamps to maintain their luminescence after a successful initiation. There is a need, therefore, for a power consumption regulator that overcomes the above problems, as well as providing additional benefits.

SUMMARY OF THE INVENTION

The present invention overcomes the limitations of the prior art and provides additional benefits. A brief summary of some embodiments and aspects of the invention are first presented. Some simplifications and omissions may be made in the following summary; the summary is intended to highlight and introduce some aspects of the disclosed embodiments, but not to limit the scope of the invention. Thereafter, a detailed description of illustrated embodiments is presented, which will permit one skilled in the relevant art to make and use aspects of the invention. One skilled in the relevant art can obtain a full appreciation of aspects of the invention from the subsequent detailed description, read together with the Figures, and from the claims (which follow the detailed description).

Under one aspect of the invention, a method for regulating the power consumption of light systems using pressurized metallic vapor lamps includes applying two or more power signals to the lamp where the first power signal is sufficient to heat the gas vapor to a temperature that causes the vapor to emit light. Once the luminescence has reached a desired level, the first power signal is removed and a second power signal having less power is applied that maintains the first level of luminescence.

The determination of when the power signals are removed and applied can be accomplished using various methodologies. One aspect of the invention uses a timer system that use two or more power settings for a finite period of time. The number of power signal, or stages, and the time that each power signal is applied can be modified to meet environmental conditions and circumstances. Alternatively, in another aspect of the invention, the luminescence of the light can be monitored and-used to control the switching of the power signals. Similarly, the temperature of the gas vapor can be determinative of the strength of the power being applied and the duration of the signal.

A further aspect of the invention is a power controller that can regulate the power consumption of light systems using pressurized metallic vapor lamps. The controller accesses multiple levels of power from a transformer and applies them to the gas pressurized lamp as determined by preset criteria. One aspect of the controller is to use finite power signals for finite periods of time. Alternatively, a sensor can monitor the luminescence of the lamp to determine when or if a successive decrease in power is warranted.

The invention can also be utilized in a network environment and be coupled to a computer or processor for more efficient and complex scenarios. The power controller described herein can be used on individual lamps or on a lighting system comprised of several lamps with no degradation in operation. These and other aspects are clearly explained in the description and claims that follow.

Figure 1:
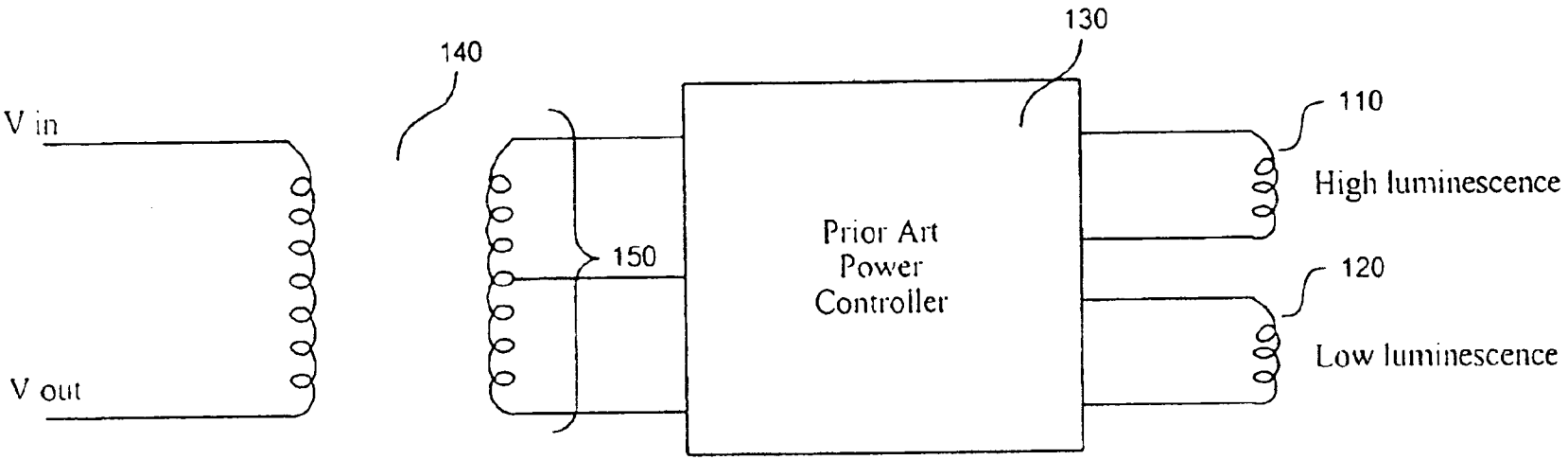
(Prior Art) Fig. 1
FIG. 1 is a block diagram of a prior art design for a gas pressurized light.

In the drawings, the same reference numbers identify identical or substantially similar elements or acts. To easily identify the discussion of any particular element or act, the most significant digit or digits in a reference number refer to the Figure number in which that element is first introduced (e.g., element 510 is first introduced and discussed with respect to FIG. 5).

As is conventional in the field of electrical circuit representation, sizes of electrical components are not drawn to scale, and various components can be enlarged or reduced to improve drawing legibility. Component details have been abstracted in the Figures to exclude details such as position of components and certain precise connections between such components when such details are unnecessary to the invention. The headings provided herein are for convenience only and do not necessarily affect the scope or meaning of the claimed invention.

DETAILED DESCRIPTION OF THE INVENTION

A power controller is presented that is capable of regulating the power consumption of gas pressurized lamps. In the following description, numerous specific details are described to provide a thorough understanding of, and enabling description for, embodiments of the invention. One skilled in the relevant art, however, will recognize that the invention can be practiced without one or more of the specific details, or with other symbols, methods, etc. In other instances, well-known structures or operations are not shown, or are not described in detail, to avoid obscuring aspects of the invention.

By varying the voltage and current provided to an individual lamp, the overall power consumption of the lamp can be reduced without significantly affecting its luminescence. Furthermore, the lower power consumption prolongs the life of the bulb significantly. The power controller, which can be employed with any lamp utilizing a gas vapor, is coupled between the power source and the lamp so as to regulate the power applied to the lamp. Initially, power sufficient to heat the gas so as to cause the gas to emit light is applied. After sufficient heating has occurred as determined by time, luminescence, temperature, or other characteristics known to one skilled in the art, the power controller decreases the power being applied to the lamp. In one embodiment the power is decreased in finite increments however a linear or other continuous form of power decrease can be used.

Once raised to a threshold temperature, the gas contained within the lamp will begin to emit light. As more heating occurs the luminescence of the lamp intensifies until reaching a state where additional power results a negligible increase in temperature or luminescence. In this state, the power necessary to initiate the light emitting qualities of the gas is in excess of the power necessary to sustain the luminescence. As power is decreased, the luminescence and temperature remain relative constant until an equilibrium point between power input and heat loss to radiation is reached. Beyond this point, any subsequent decrease in power will result in a corresponding decrease in temperature and correspondingly, luminescence. One embodiment of the power controller regulates the power applied to the lamp so as reach and maintain this equilibrium position efficiently. This equilibrium state provides substantially the same luminescence and prolongs the life of the lamp at least 200%.

Much of the detailed description provided herein is explicitly disclosed in the provisional patent application; much of the additional material of aspects of the invention will be recognized by those skilled in the relevant art as being inherent in the detailed description provided in such provisional patent application, or well known to those skilled in the relevant art.

Figure 2:
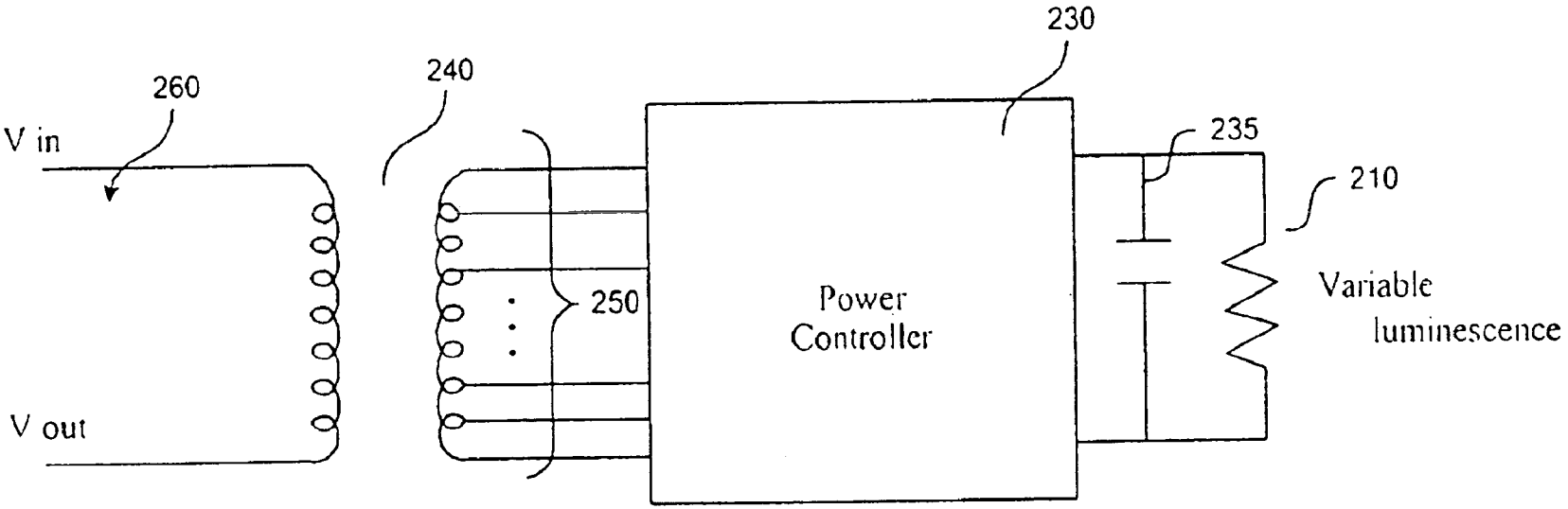
FIG. 2 is a block diagram of one embodiment of a power controlling system for regulating the power consumed by a gas pressurized light.

FIG. 2 is a block diagram showing one embodiment of a power controlling system for the regulation of power consumption of gas pressurized lights. Unless described otherwise below, the construction and operation of the various blocks shown in FIG. 2 are of conventional design. As a result, such blocks need not be described in further detail herein, because they will be understood by those skilled in the relevant art. Such further detail is omitted for brevity and so as not to obscure the detailed description of the invention. Any modifications necessary to the blocks in FIG. 2 (or other embodiments) can be readily made by one skilled in the relevant art based on the detailed description provided herein. A gas pressurized lamp 210 is connected to a power controller 230 in series with a capacitor 235. The power controller 230 is in turn connected to a transformer 240, which is capable of outputting two or more taps of voltage 250. The decreasing taps of voltage can vary from the full voltage differential 260 of $V_{in}$ to ground of zero volts, $V_{out}$. The power controller 230 provides power to the gas pressured lamp to sufficiently raise the temperature of the gas vapor to cause the vapor to emit light. Upon achieving luminescence, the power controller 230 steps down the power being applied to the lamp. The power is decreased in stages while substantially maintaining the lamp's luminescence. One suitable embodiment of a power controller 230 is described in more detail below in FIG. 3.

Figure 3:
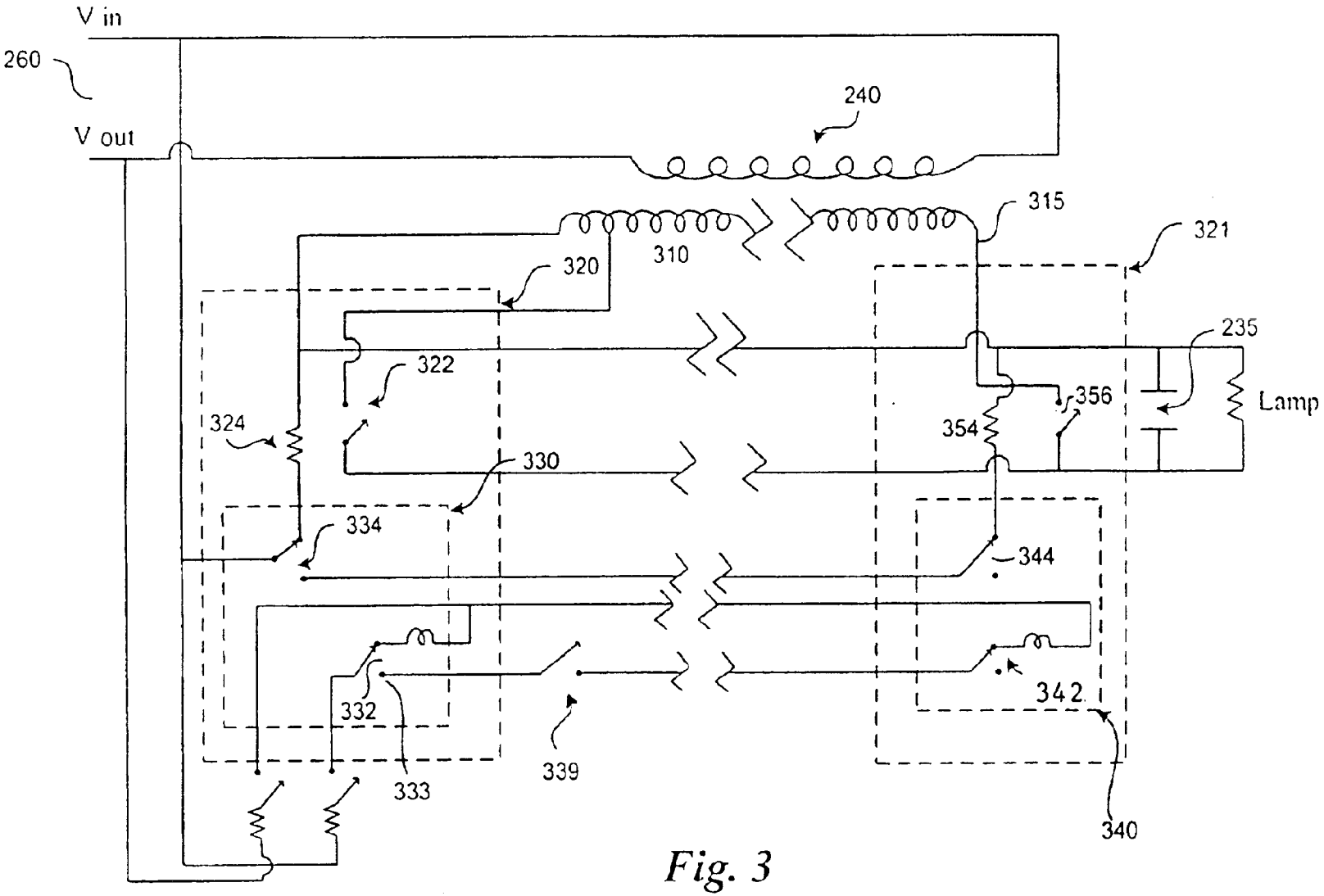
FIG. 3 is a circuit diagram of one embodiment of a power consumption controller for the regulation of the power consumed by a gas pressurized light.

FIG. 3 shows one embodiment of a power consumption controller for regulating the power consumed by gas pressurized lamps. One coil of the transformer 240 is connected to the voltage differential 260 as provided by the local power grid. The opposing coil of the transformer 240 includes, in one embodiment, multiple voltage taps ranging from the maximum voltage of the power source 260 to zero. In one embodiment the taps of the transformer range from 115 volts to 85 volts in 5 volt increments. In another embodiment the taps vary from 220 volts to 160 volts in 10 volt increments.

A first tap 310 possessing a first power signal is directed toward a stage 320 of the power controller while a second tap 315 is directed toward another identical, yet separate stage 321. The power controller 230 can include multiple stages configured in series matching to the multiple taps 250 coming off the transformer 240. The stage 320 includes a contactor 322, a driving coil 324, and a relay 330. The stage 321 includes a contactor 356, a driving coil 354, and a relay 340.

The relay 330 includes a low power two position connector switch 332 operable according to a sensor input, timer, or similar criteria, and a high power two position connector switch 334 connected to the driving coil 324. Initially, the low power connector 332 is in the upper position (as shown in FIG. 3) operating to close the high power connector 334. With the high power connector 334 in the upper position the driving coil is charged closing the contactor 322. In an another embodiment an indicator light (not shown) is placed in parallel with the driving coil to indicate what stage is active. Once the contactor 322 is closed, the voltage associated with the first tap 310 is delivered to the lamp 315. Minor variations in power are compensated by the capacitor 235.

In one embodiment the initial relay 330 is a timer relay configured to cause the contactor 322 to be initially closed providing maximum power to the lamp 210 for a predetermined period of time. Upon expiration of that time, the low power connector switch 332 changes to the lower position 333 providing low power to the next stage's lower power line. A circuit breaker 339 can be placed between the stages to prevent any undesirable voltage spikes from traveling to subsequent stages. Upon the altering of the low power connector switch 332, the high power connector switch also changes to the lower position sending high power to the subsequent stage.

With the low power connector switch 334 now in the lower position, power is removed from the driving coil 324 causing the contactor 322 to open. The opening of the contactor 322 removes power from the lamp.

Simultaneously, upon the switching of the low power connector switch 332, the low power circuit of the next stage 321 is energized. As described herein, the low power connector is biased toward the upper position causing the high power connector switch 344 to power the driving coil 354. The driving coil 354 causes the connector 356 to close delivering the second tap voltage 315 from the transformer to the lamp 210. Several stages following the same procedure can be placed in series to selectively step down the power being delivered to the lamp. The final stage's low power connector switch 342, in this embodiment, remains in the upper position to maintain the lamp's luminescence indefinitely. While this embodiment employed timer relays, other criteria could be used to drive the position of the low power connector switch. Alternatively, a processor can be coupled to the relays and to a variety of sensors for the collection of data to more accurately control the movement of the switches. The term "processor" as generally used herein refers to any logic processing unit, such as one or more central processing units (CPUs), digital signal processors (DSPs), application-specific integrated circuits (ASIC), etc.

Figure 4:
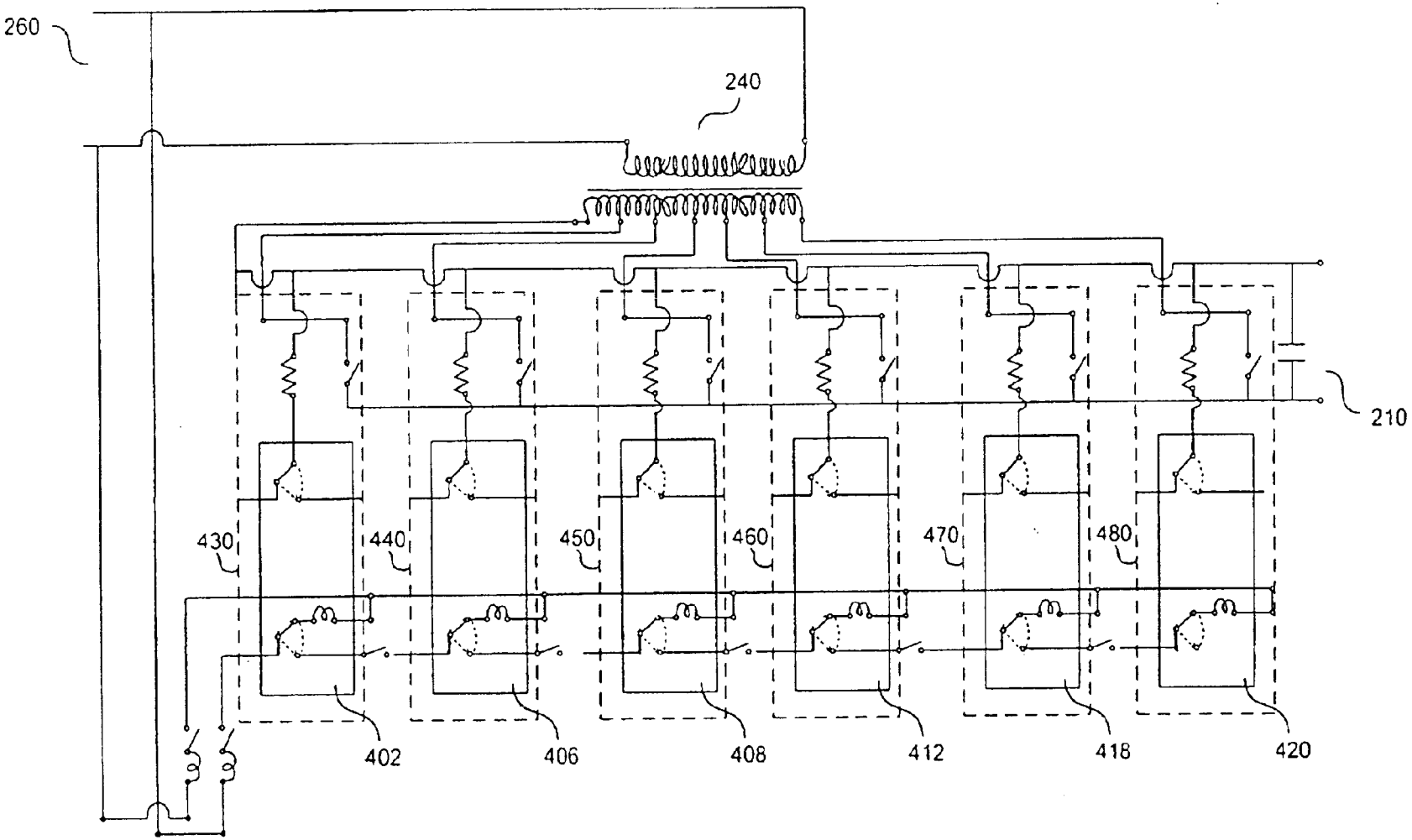
FIG. 4 is a schematic diagram of one embodiment of a power consumption controller having 6 stages for the regulation of power consumed by a gas pressurized light.

FIG. 4 is a schematic diagram of one embodiment of a power consumption controller having 6 stages 430–480 for the regulation of power consumed by a gas pressurized light. Circuits of the type depicted in FIG. 4 are known in the art and one of ordinary skill in the art would be able to use known circuits of this type in the depicted combination, and as described herein, to practice the invention. In this embodiment each stage is governed by a timer relay that decreases the voltage to the lamp on a predetermined schedule. As depicted the first stage 430 provides power associated with the volt potential applied to the circuit 260 directly to the lamp 210. In one embodiment a voltage penitential of 220 volts can be applied. The voltage is subsequently decreased to 200 volts by the second stage 440 and decreases 10 volts per stage thereafter 450–470 until arriving at the final stage 480 of a constant 160 volts. Each stage possesses a relay that governs the stage's implementation. Stage one 430, for example, is associated with relay 402, stage two 440, is associated with relay 406, and so forth.

Figure 5:
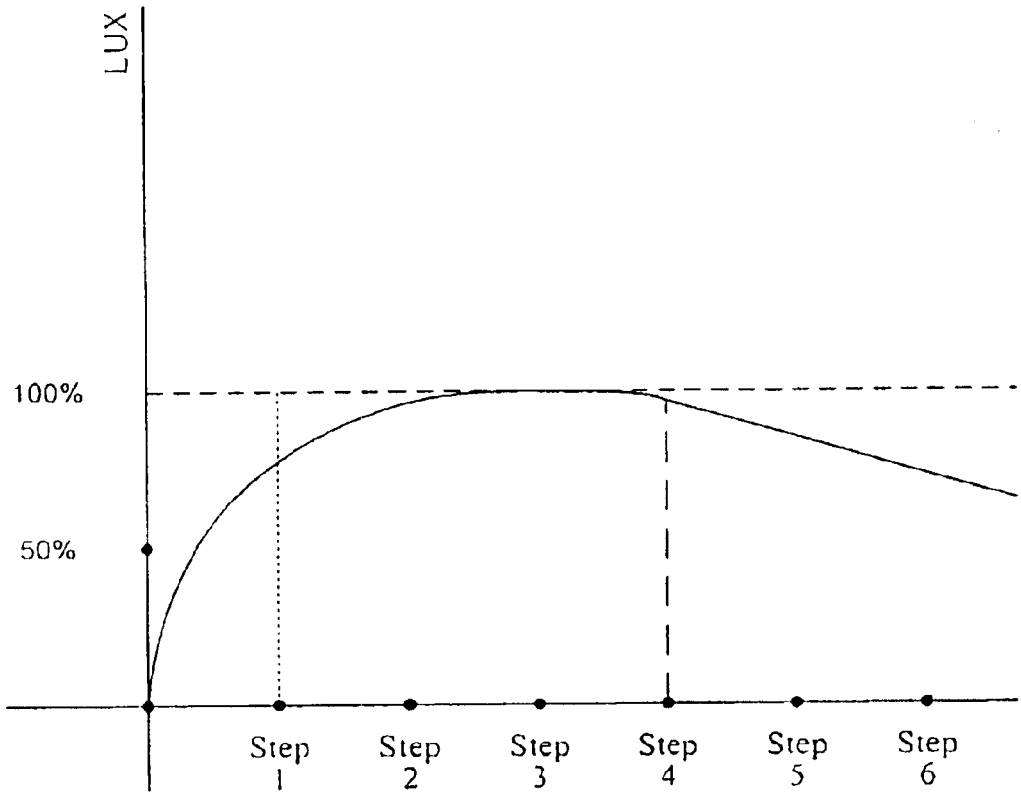
FIG. 5 is a graph showing a relationship between luminescence and 6 step reductions in power from the power consumption device of FIG. 4.

FIG. 5 is a graph showing a typical luminescence response to the staged power decrease of the embodiment shown in FIG. 4. Initially, full power is applied to the lamp and as the gas vapor heats, the luminescence increases to full intensity. At approximately 1 minute, the first relay steps the power down to 200 volts. As the power is still in excess of the power needed to maintain luminescence, the luminescence line remains at 100%. Likewise, two more reductions of power do not alter the luminescence of the lamp. Upon the fourth reduction in voltage, the power being applied to the lamp is no longer sufficient to maintain 100% luminescence. Thereafter, the luminescence begins to decrease according to a linear relationship known to one skilled in the art.

Figure 6:
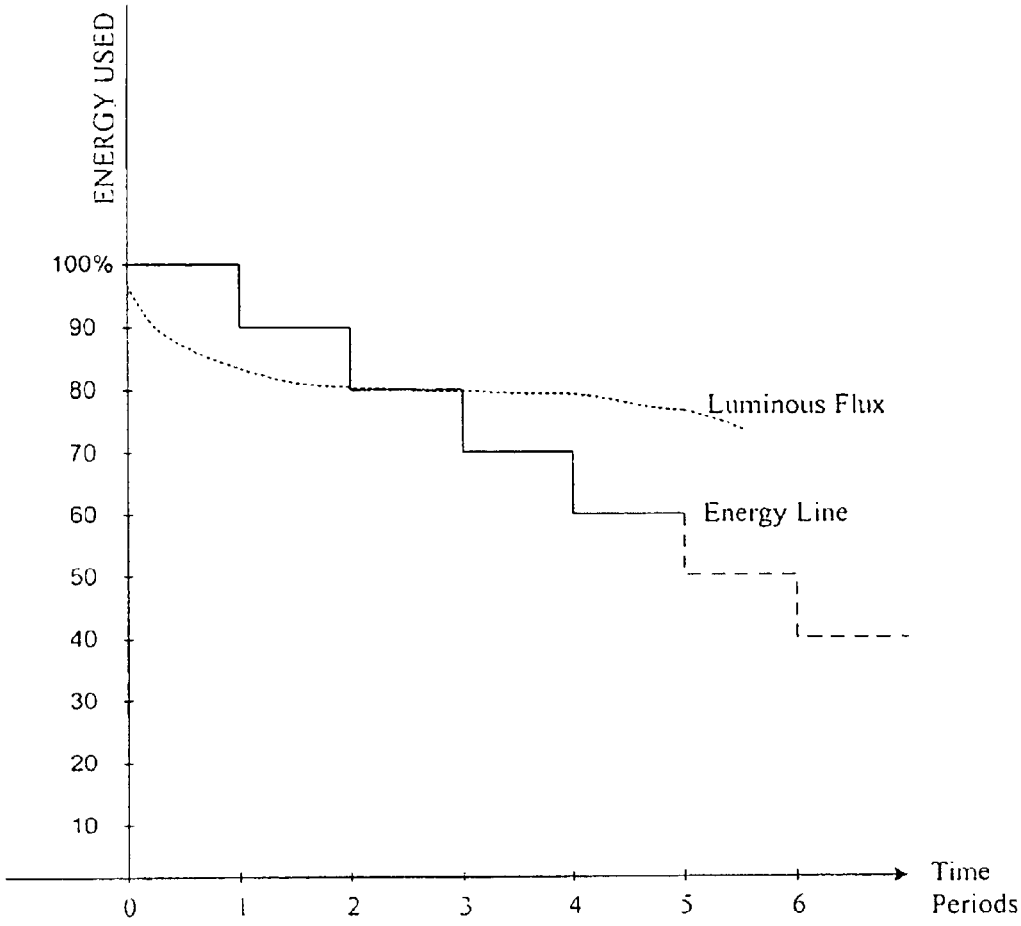
FIG. 6 is a graph showing a relationship between the luminous flux of a gas pressurized light and a step reduction in power.

FIG. 6 is a graph showing the relationship of the luminous flux and energy level in response to the staged power decrease of the embodiment shown in FIG. 4. Initially, 100% power is applied to the lamp. As the lamp requires the power to heat the gas vapor, the power available is used at a decreasing rate. As the power is in excess of the power required to sustain luminescence, the light remains at 100% brightness as shown in FIG. 5. After approximately one minute in this embodiment, the first stage decreases the power to the lamp. As the available power is still in excess of the power required the light remains fully illuminated. The next drop in voltage matches the luminous flux of the light. If the light is to be maintained at 100% luminescence, this power level should be perpetuated. As the power continues to be decreased, a gap between the luminous flux (out flowing energy) and incoming energy grows. Eventually, the disparity between the energy being supplied by the power controller and the luminous flux will cause the gas temperature to decrease and seek new energy equilibrium causing a decrease in luminescence. If that equilibrium is too low the gas may no longer emit light.

Figure 7:
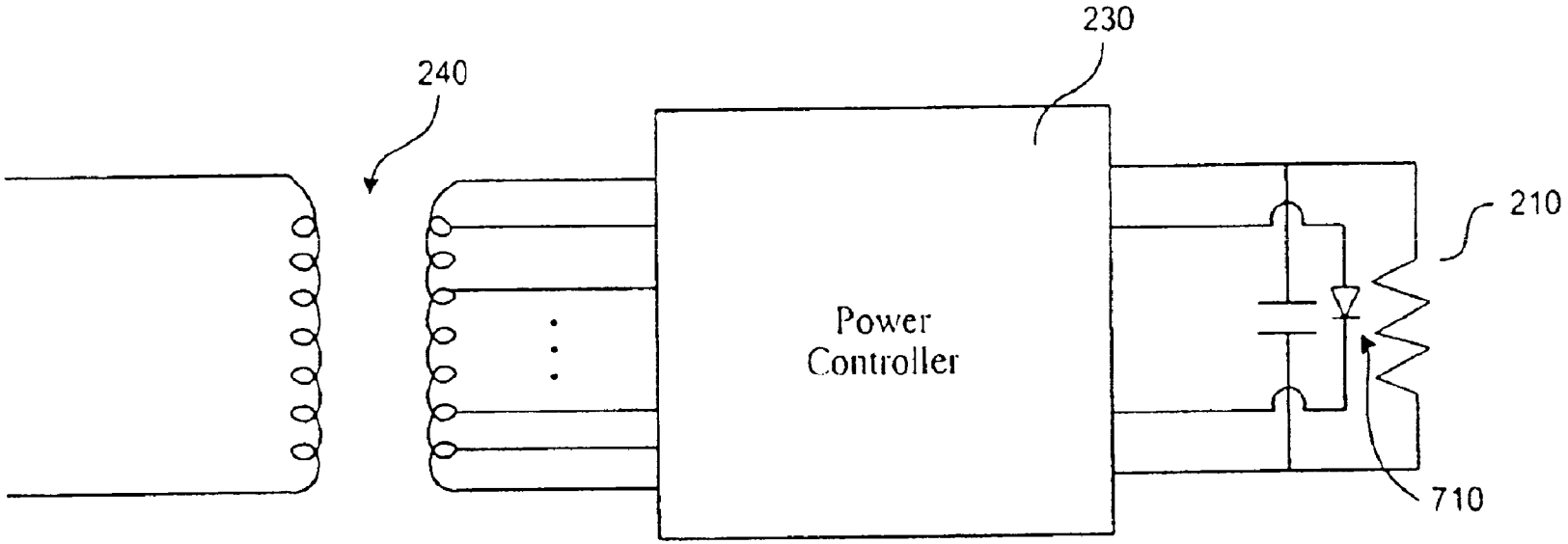
FIG. 7 is a block diagram showing one embodiment of the power consumption controller of FIG. 2 having a sensor.

FIG. 7 shows one embodiment of a power consumption controller for regulating the power consumed by gas pressurized lamps. The lamp 210 is coupled to the power controller 230 as described herein. Additionally, one or more sensors 710 can be coupled to the controller. The sensors can include light sensitive switches, thermocouples, or more sophisticated data collection devices that are well known to one skilled in the art. In preferred embodiments, the power controller 230 uses the feedback provided by the sensor 710 to maintain a desired luminescence with the least amount of power consumption.

Figure 8:
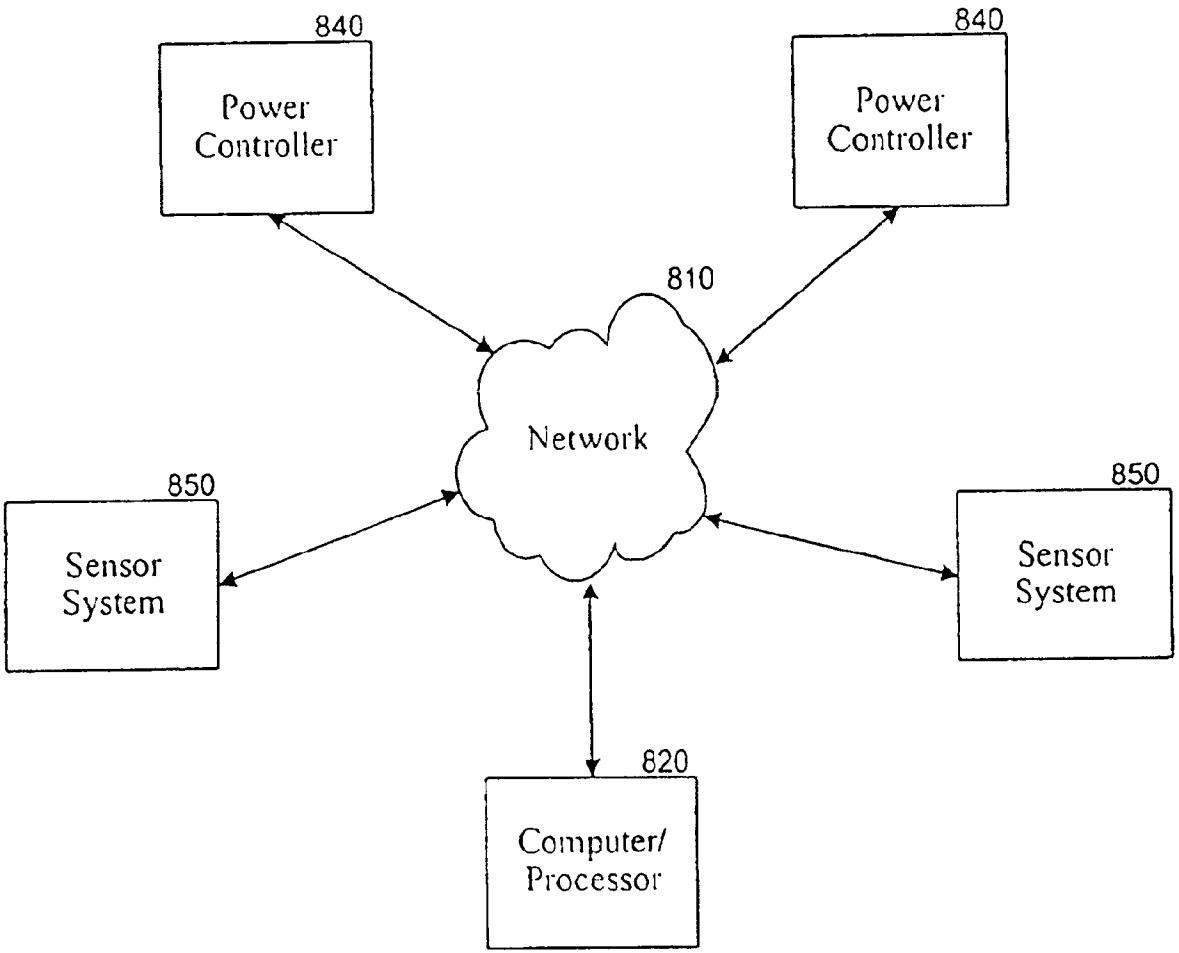
FIG. 8 is a block diagram of one environment of a network environment using two or more power consumption devices.

FIG. 8 is a block diagram of one embodiment of two or more devices for the regulation of power consumption of gas pressurized lights coupled to a network. The network 810 is coupled to, in this embodiment, two power regulation devices 840. Sensors 850 for measuring the luminescence or other characteristics associated with the determination of luminescence are also coupled to the network. Additionally, a computer or processor is communicatively is coupled to the network for collection of data and for directing the activity of the regulation devices 840. In an alternative embodiment, a single regulation device can be coupled to a plurality of lamps. Sensors associated with the area serviced by the lights collect data and convey it to the processor for analysis and action. In such an embodiment, the regulation device can be placed at an electrical substation responsible for several lamps.

FIG. 8 and the following discussion provides a brief, general description of a suitable environment in which aspects of the invention can be implemented. Although not required, embodiments of the invention can be described in the general context of computer-executable instructions, such as routines executed by a general-purpose computer (e.g., a server or personal computer). Those skilled in the relevant art will appreciate that aspects of the invention can be practiced with other computer system configurations, including Internet appliances, hand-held devices, wearable computers, cellular or mobile phones, multi-processor systems, microprocessor-based or programmable consumer electronics, set-top boxes, network PCs, mini-computers, mainframe computers and the like. Aspects of the invention can be embodied in a special purpose computer or data processor that is specifically programmed, configured or constructed to perform one or more of the computer-executable instructions explained in detail below. Indeed, the term "computer," as used generally herein, refers to any of the above devices, as well as any data processor.

Aspects of the invention can also be practiced in distributed computing environments where certain tasks or modules are performed by remote processing devices and which are linked through a communications network, such as a Local Area Network ("LAN"), Wide Area Network ("WAN") or the Internet. In a distributed computing environment, program modules or subroutines may be located in both local and remote memory storage devices. Aspects of the invention described herein may be stored or distributed on computer-readable media, including magnetic and optically readable and removable computer disks, hard-wired or preprogrammed in chips (e.g., EEPROM semiconductor chips), as well as distributed electronically over the Internet or over other networks (including wireless networks).

Figure 9:
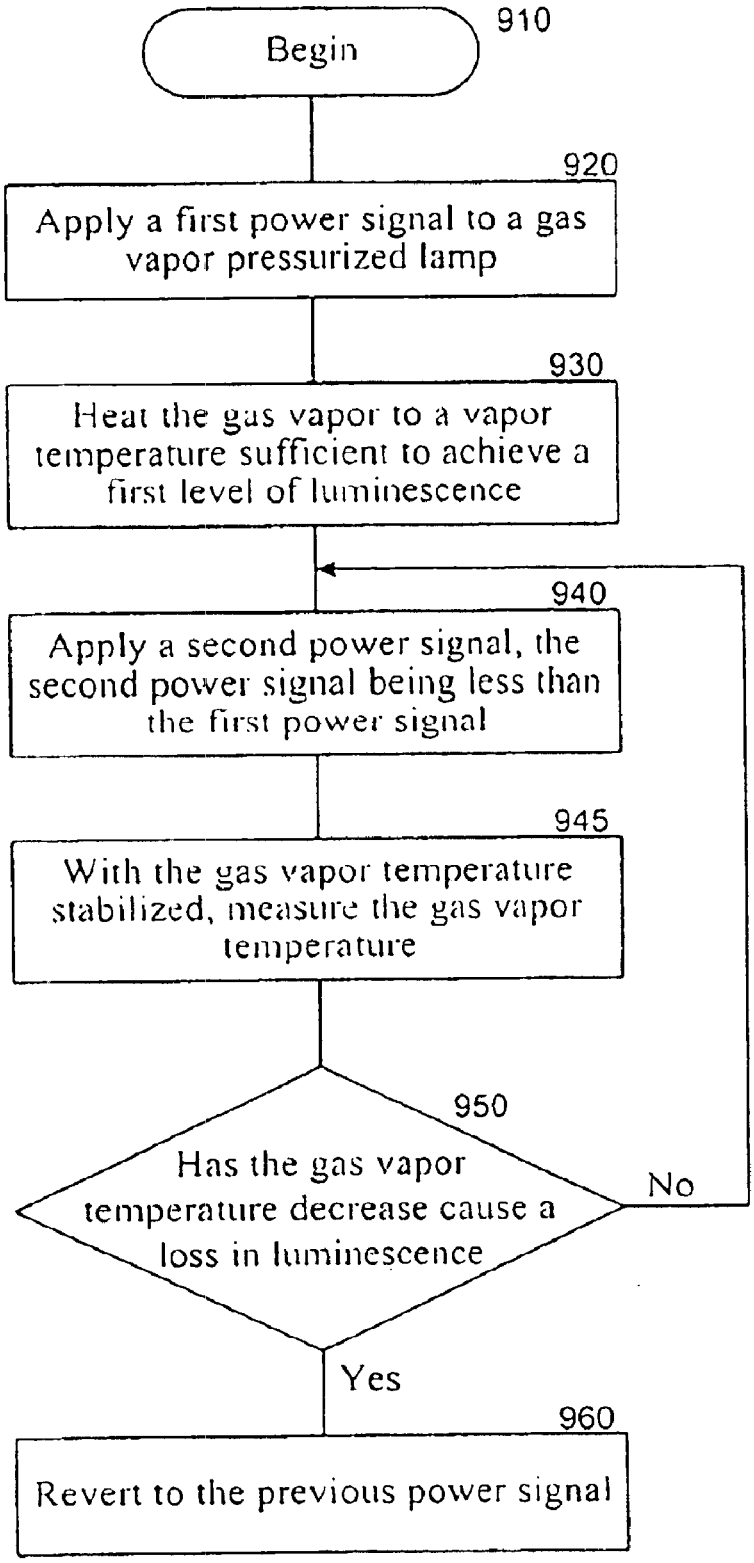
FIG. 9 is a flow chart of one embodiment of a method for regulating power consumption of a gas pressurized light.
Figure 10:
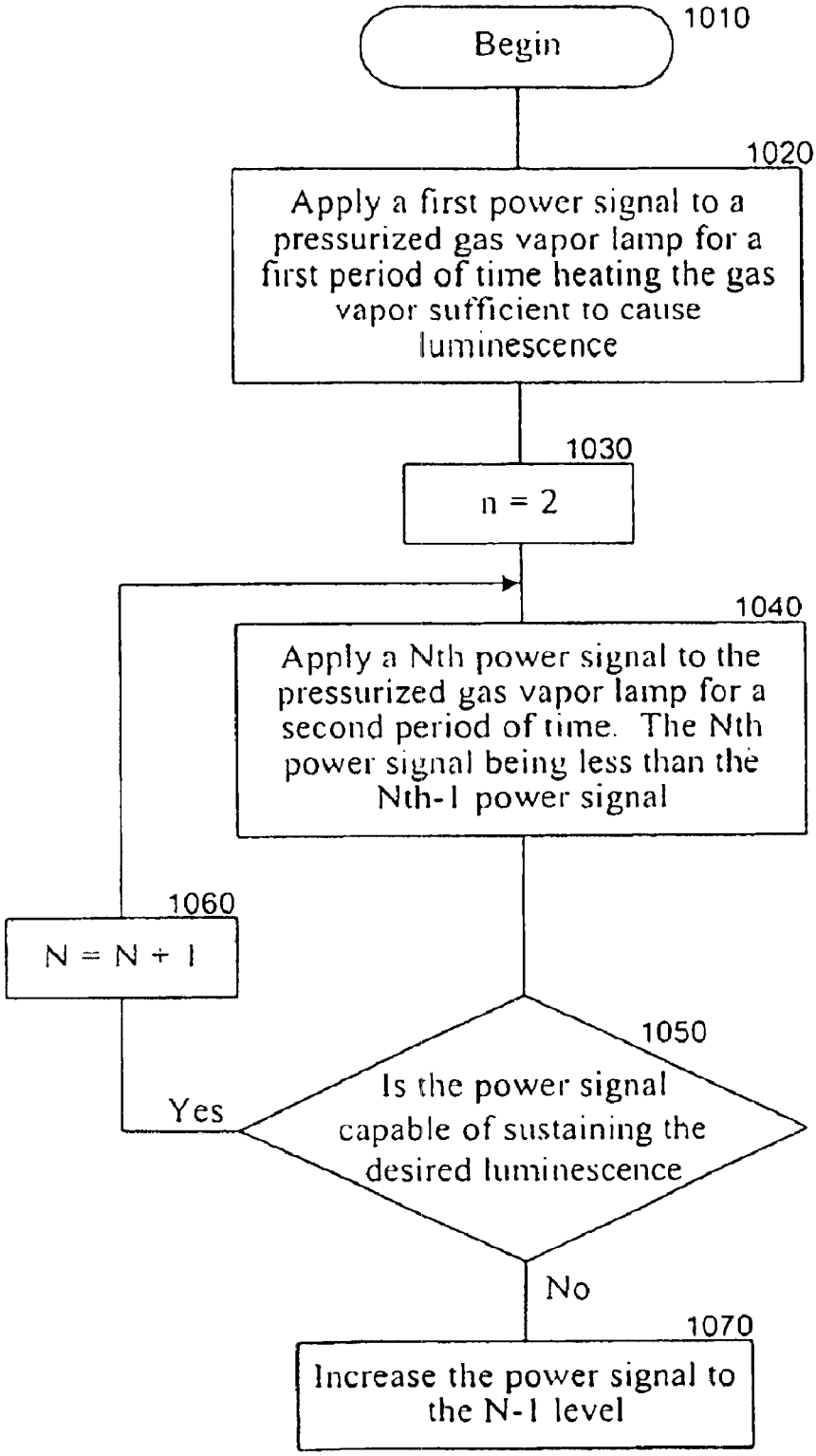
FIG. 10 is a flow chart of one embodiment of a method for regulating power consumption of a gas pressurized light.
Figure 11:
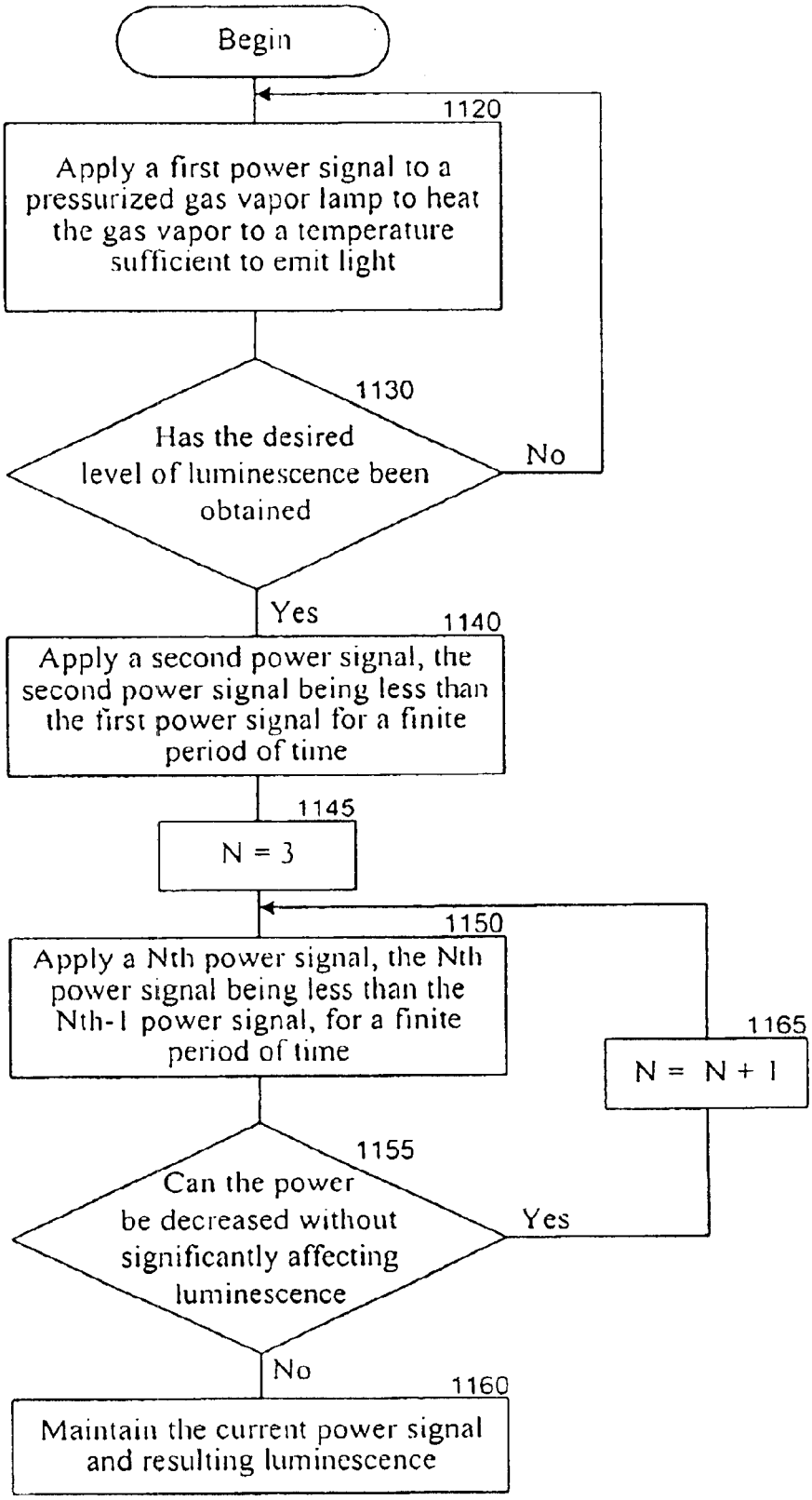
FIG. 11 is a flow chart of one embodiment of a method for regulating power consumption of a gas pressurized light.

Those skilled in the relevant art can implement aspects of the invention based on the flowcharts of FIGS. 9-11 and the detailed description provided herein. FIG. 9 is a flow chart of one embodiment of a method for regulating the power consumption of gas pressurized lights. The method begins, at block 910, by performing any required initiation. At block 920, a first power signal is applied to the pressurized lamp. As the lamp receives power, a filament or similar element of the lamp heats the gas vapor disposed inside the evacuated bulb, at block 730, until it reaches a level where the vapor begins to emit light. This first level of luminescence stabilizes after the gas temperature reaches equilibrium. After a pre-determined set of criteria have been achieved, such as time or gas vapor temperature, a second power signal is applied to the lamp, at block 940, where the second power signal possesses less power than the first power signal. After allowing any fluctuations in gas temperature to stabilize, the temperature of the gas vapor is measured, at block 950, to see if it has decreased, at block 955. If the temperature remains constant and thus produces a constant luminescence, the method returns to the previous step, block 940, and applies a power signal that is less than the previous power signal. If the measurement of the vapor temperature determines that the temperature is decreasing resulting in a loss of luminescence, the power controller reverts, at block 960, to the previous power signal, which maintained the desired vapor temperature.

Another embodiment of a method to regulate power consumption of gas pressurized lamps is shown in FIG. 10. A power signal is applied to the lamp, at block 1020, for a finite period of time sufficient to heat the gas vapor to a temperature that will cause the gas vapor to emit light. An $N^{th}$ power signal is then applied that is less than the first power signal, at block 1040, for a finite period of time. The method then examines, at block 1050, if the power being applied to the lamp is sufficient to maintain the desired level of luminescence. If the luminescence remains acceptable, the counter is increased, at block 1060, and the power signal is once again reduced. If it is determined that the power being applied cannot sustain the desired luminescence level, the power is increased, at block 1070, to the $N^{th}-1$ power level and the system reverts to a maintenance mode with no further reductions in power.

An alternative embodiment for a method to regulate power consumption of gas pressurized lights is also shown in FIG. 11. As before, a power signal is applied to the lamp for a period of time sufficient to heat the gas vapor, at block 1120, to a temperature necessary to emit light. The power remains applied to the vapor for a finite period of time, or in the alternative, until it is determined, at block 1130 that the desired level of luminescence has been reached. Once luminescence is achieved, or after the finite time period has expired, a second power signal that is less than the first is applied, at block 1040, to the lamp. After a finite time period, the second power signal is removed and a third power signal is applied, at block 1050, the third power signal being less than the second. This process continues until an $N^{th}$ power signal is applied, at block 1060, to the lamp, which is held constant to maintain the current level of luminescence. The number of stages decreasing the power being applied to the lamp, and the time each power signal is applied to the lamp can be tuned so as to obtain a desired luminescence with minimal expenditure of power.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," and words of similar import, when used in this application, shall refer to this application as a whole and not to any particular portions of this application.

The above detailed descriptions of embodiments of the invention are not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

In general, the terms used in the following claims should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

What is claimed is:

1. A method for regulating power consumption of a pressurized gas light system including at least one lamp having a metallic vapor, the method comprising the acts of:

applying two or more power signals to the at least one lamp, and adjusting a duration of the application of each of the two or more power signals to determine a minimal power signal sufficient to maintain a first luminescence level wherein a first power signal of the two or more power signals is applied to heat the metallic vapor to a first vapor temperature sufficient to cause the metallic vapor to begin emitting light substantially at the first luminescence level;

the first power signal is removed after the metallic vapor has been heated to the first vapor temperature; and a second power signal of the two or more power signals is applied to the lamp upon the removal of the first power signal, the second power signal being less than the first power signal, wherein the second power signal is sufficient to maintain the metallic vapor at a second vapor temperature, the second vapor temperature being less than the first vapor temperature, and causing the metallic vapor to emit light substantially at the first luminescence level.

2. The method of claim 1, wherein the first power signal has a first voltage and the second power signal has a second voltage, the second voltage being less than the first voltage.

3. A method for regulating power consumption of a pressurized gas light system having at least one lamp, the lamp having a metallic vapor, the method comprising the acts of:

applying two or more power signals, to the at least one lamp; wherein a first power signal of the two or more power signals being applied for a first period of time, the first period of time sufficient for the first power signal to heat the metallic vapor to a first vapor temperature causing the metallic vapor to emit light substantially at a first luminescence level;

replacing the first power signal with a second power signal of the two or more power signals for a second period of time, the second power signal being less than the first power signal, wherein the second power signal is sufficient to cause a second vapor temperature, the second vapor temperature being less than the first vapor temperature and causing the metallic vapor to emit light substantially at a second luminescence level, the second luminescence level being less than the first luminescence level; and replacing the second power signal with a third power signal of the two or more power signals, the third power signal being less than the second power signal, wherein the third power signal is sufficient to maintain the lamp at the second luminescence level.

4. A method for regulating power consumption of a pressurized gas light system having at least one lamp, the lamp having a metallic vapor; the method comprising the acts of:

applying a first power signal to the at least one lamp, the first power signal being operable to heat the metallic vapor to a first vapor temperature causing the metallic vapor to emit light at a luminescence level;

removing the first power signal upon sensing the lamp emitting at the luminescence level;

applying a second power signal to the at least one lamp upon the removal of the first power signal, the second power signal being less than the first power signal, the second power signal substantially maintaining the luminescence level wherein a duration of the application of each of the first and second power signals is adjusted to determine a minimal power signal sufficient to maintain the luminescence level.

5. A power controller for regulating power consumption of a pressurized gas light system, the light system having at least one lamp, the lamp having a metallic vapor, the controller comprising:

two or more stages coupled to a transformer, each stage having a contactor and a relay configured to supply the lamp with a stage dependent power signal as determined by the relay, wherein a first of the two or more stages provides the at least one lamp a first power signal operable to heat the metallic vapor of the lamp to a vapor temperature sufficient to emit light at a first luminescence level, and wherein a second of the two or more stages provides the lamp a second power signal, the second power signal being less than the first power signal and the second power signal maintaining the light at substantially the first luminescence level.

6. The controller of claim 5 wherein the relay is a timer relay operable to drive the contactor of each stage according to a preset time period.

7. The controller of claim 5 wherein each of the two or more stages includes an indicator light showing if the stage dependent power signal is active.

8. The controller of claim 5 further comprising a vapor temperature sensor coupled to the relay operable to drive the contactor of each stage according to the vapor temperature.

9. The controller of claim 5 further comprising a luminescence sensor coupled to the relay operable to drive the contactor of each stage according to the luminescence of the lamp.

10. The controller of claim 5 wherein each relay is isolated by a circuit breaker.

11. A power controller for regulating power consumption of a pressurized gas light system, the light system having at least one lamp coupled to a power source, the lamp having a metallic vapor, the controller comprising:

a transformer coupled to the power source for providing two or more power signals, wherein a first power signal of the two or more power signals is sufficient to heat the metallic vapor of the at least one lamp to a vapor temperature sufficient to cause the at least one lamp to emit light at a first luminescence level, and wherein a second power signal of the two or more power signals, the second power signal being less than the first power signal, is sufficient to maintain the at least one lamp at the first luminescence level, two or more contactors, each contactor configured to provide the at least one lamp with one of the two or more power signals; and two or more relays, each relay being coupled to one of the two or more contactors and operable to drive the contactor.

12. The power controller of claim 11 further comprising a sensor system coupled to the two or more relays.

13. The power controller of claim 12, wherein the sensor system measures the lamp luminescence.

14. The power controller of claim 12, wherein the sensor system measures the vapor temperature.

15. The power controller of claim 11, wherein the first power signal has a first voltage and wherein the second power signal has a second voltage, the second voltage being less than the first voltage.

16. A power controller for regulating powers consumption of a pressurized gas light system, the light system having at least one lamp coupled to a power source, the at least one lamp having a metallic vapor, the controller comprising:

a staging means for coupling the at least one lamp to two or more power signals, wherein a first power signal is sufficient to heat the metallic vapor to a vapor temperature causing the at least one lamp to emit light at a first luminescence level; and a driving means for determining which of the two or more power signals is coupled to the at least one lamp, the driving means including two or more relays; and a sensor system coupled to the two or more relays.

17. The power controller of claim 16 further comprising a second power signal, the second power signal being less than the first power signal, sufficient to cause the lamp at least one to emit light substantially at the first luminescence level.

18. The power controller of claim 16, wherein the two or more relays are timer relays.

19. A system for regulating power consumption of a pressurized gas light system having at least one lamp, the lamp having a metallic vapor; the system comprising:

a transformer for delivering two or more power signals, wherein a first power signal of the two or more power signals is sufficient to heat metallic vapor of the lamp to a vapor temperature sufficient to cause the lamp to emit light at a first luminescence level, and wherein a second power signal of the two or more power signals, the second power signal being less than the first power signal, is sufficient to maintain the lamp at the first luminescence level; and a power controller coupled to the transformer, the controller having two or more contactors, each contactor configured to provide the lamp with one of the two or more power signals, and two or more relays, each relay being coupled to one of the two or more contactors and operable to drive the contactor.

20. The system of claim 19, wherein the power controller includes a processor for executing instructions directing the relays.

21. The system of claim 20, further comprising a sensor system coupled to the power controller, the sensor system configured to monitor the lamp luminescence.

22. The system of claim 20, further comprising a sensor system coupled to the power controller, the sensor system configured to monitor the vapor temperature.

* * * * *